US005239903A

United States Patent [19]

Rosas et al.

[11] Patent Number: 5,239,903

[45] Date of Patent: Aug. 31, 1993

[54] DEVICE FOR SEVERING AND HOLDING A TORN WEB

[75] Inventors: Alfredo Rosas, Diedorf; Werner Kettl, Neusäss; Karl Veh, Diedorf, all of Fed. Rep. of Germany

[73] Assignee: Grafotec Kotterer GmbH, Diedorf, Fed. Rep. of Germany

[21] Appl. No.: 894,563

[22] Filed: Jun. 5, 1992

[30] Foreign Application Priority Data

Jul. 23, 1991 [DE] Fed. Rep. of Germany ..... 4124391

[51] Int. Cl.[5] ..... B26D 7/02; B41F 13/60

[52] U.S. Cl. ..... 83/456; 83/371; 83/566; 83/613

[58] Field of Search ..... 225/104, 105, 23; 83/18, 175, 856, 613, 658, 566, 456, 698, 371, 639.1

[56] References Cited

U.S. PATENT DOCUMENTS

| | | | |
|---|---|---|---|
| 2,293,721 | 8/1942 | Engler | 83/566 X |
| 3,082,923 | 3/1963 | Ford et al. | 225/104 |
| 3,277,756 | 10/1966 | Des Jardins et al. | 83/698 X |
| 3,685,251 | 8/1972 | Mahaffy et al. | 83/566 X |

FOREIGN PATENT DOCUMENTS

| | | |
|---|---|---|
| 0037642 | 10/1981 | European Pat. Off. . |
| 3822497 | 10/1989 | Fed. Rep. of Germany . |

*Primary Examiner*—Eugenia Jones
*Attorney, Agent, or Firm*—Harrison & Egbert

[57] ABSTRACT

In an apparatus for severing and holding a torn web for a web processing machine and more particularly for a web feed rotary printing press, comprising a knife beam having a stationary knife and arranged across the conveying plane of the web, and furthermore a strike beam having a hump adapted to come into functional engagement with the knife and which by means of an associated push-out means is able to be lifted and lowered, said means being adapted to be activated by a web tear detector, it is possible to have a design with simple and low-cost means so that the device is not only of universal application but furthermore ensures a high degree of operator safety, if the knife beam comprises two identical, bar-like knife carriers holding the knife between them, which adjacent to their side facing the strike beam are provided with symmetrically arranged holders for elastic bars flanking the knife, which bars project in relation to the cutting edge of the knife and are spaced apart by a distance at least equal to the width of the hump on the strike beam, such strike beam being formed symmetrically in relation to the plane of cutting and having two gripper surfaces which are associated with the elastic bars and flank the hump which is provided with a cutting groove, into which the knife may be introduced.

12 Claims, 2 Drawing Sheets

DEVICE FOR SEVERING AND HOLDING A TORN WEB

BACKGROUND OF THE INVENTION

The present invention relates to an apparatus for severing and holding a torn web for a web processing machine and more particularly for a web feed rotary printing press, comprising a knife beam having a stationary knife and arranged across the conveying plane of the web, and furthermore a strike beam having a hump adapted to come into functional engagement with the knife and which by means of an associated push-out means is able to be lifted and lowered, said means being adapted to be activated by a web tear detector.

A device of this type is for instance described in the German patent publication 3,822,497 A1. In the case of prior art devices of this type the knife and the hump of the strike beam are so arranged that the knife may move past a flank of the hump. This leads to an asymmetrical structure and the consequence is that in a case in which one of the two ends of the severed paper is held and the other is released, one respective design is necessary for both alternatives. Since in practice both alternatives occur, the equipment has so far been complex. In conjunction with this it is to be assumed that one run of the torn paper web will generally wind itself up on a roll and therefore has to be released at the point of cutting, while the other run, which extends as far as the tear should be held fast. A further disadvantage of the known devices is that the web may not be reliably severed by means of the knife moving past one flank of the hump on the strike beam. The web, which is then practically running slack owing to the tear is able to move out of the way of the knife. For this reason the known equipment is unsuitable, more particularly in the case of working on thick material. A further and more particularly serious disadvantage of the known equipment is that there is a considerable risk of injury. In this connection it is to be assumed that the knife moving past one flank of the hump is readily accessible from the side.

SHORT SUMMARY OF THE PRESENT INVENTION

Taking this state of the art as a starting point one object of the present invention is to provide a device of the type initially mentioned so improved using simple and low-cost means that the device is not only of universal application but furthermore ensures a high degree of operator safety.

In order to achieve these and/or other objects appearing from the present specification, claims and drawings, in the present invention the knife beam comprises two identical, bar-like knife carriers holding the knife between them, which adjacent to their side facing the strike beam are provided with symmetrically arranged holders for elastic bars flanking the knife, which bars project in relation to the cutting edge of the knife and are spaced apart by a distance at least equal to the width of the hump on the strike beam, such strike beam being formed symmetrically in relation to the plane of cutting and having two gripper surfaces which are associated with the elastic bars and flank the hump which is provided with a cutting groove, into which the knife may be introduced.

These features lead to the advantage of a symmetrical design of the arrangement in accordance with the invention. It is therefore readily possible to so turn the knife beam that the sides are changed over without it being necessary to turn the strike beam and it is therefore possible as well to make elastic bars with a different height in order to ensure unilateral gripping of the web so that the higher bar may function as a gripper bar. By simply turning the knife beam it is possible in this respect to freely select the side on which gripping is to take place. The features in accordance with the invention therefore render possible a rational prefabrication and simple fitting. Owing to the symmetrical structure it is possible for the knife to have an associated cutting groove, same ensuring an exact cuting action, by which any type of paper may be severed. Furthermore the clamping of the knife between two knife carriers, which owing to the stationary knife arrangement may have a closed outline in section, leads to greater strength and resistance to twisting. A further advantage of the arrangement in accordance with the invention is that the lateral bars, of which one may function as a gripper bar, simultaneously prevent access to the knife from the side. Furthermore the elastic bars function as buffers so that when the device in accordance with the invention is tripped it is in no case possible for metal to strike against metal, this not only being an advantage as regards preventing noise but also as regards avoiding injury. In this connection it is namely to be assumed that it may be possible for the operator to put his or her finger or even his whole hand in the device in accordance with the invention. If then the strike beam is actuated his finger or hand will be clamped but the elastic bars will ensure a buffering or cushioning action so that the impact will be reduced.

Although the European patent publication 0 037 642 B1 describes a device for severing and holding a torn printed web in the case of which the knife beam is provided with two elastic bars projecting past the knife which they flank, the knife is in this case however not arranged stationarily but is moved by the strike beam acting through the intermediary of a lever arrangement. This practically means that a symmetrical arrangement is impossible and there is the further disadvantage of slow operation caused by the double arrangement. In conjunction with this it is namely to be assumed that the strike beam has to perform a large stroke despite the double movement in order to create sufficient free space to cope with the flutter of the web. Apart from this the knife beam has to have a cross section which is open in a downward direction so that the result arrangement is able to be twisted. A further point to be considered is that the moving knife here as well only cuts on one flank of the hump on the strike beam so that problematical material may not be sufficiently reliably severed.

Further advantageous developments and convenient forms of the invention will be gathered from the claims and from the following detailed account of one embodiment thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
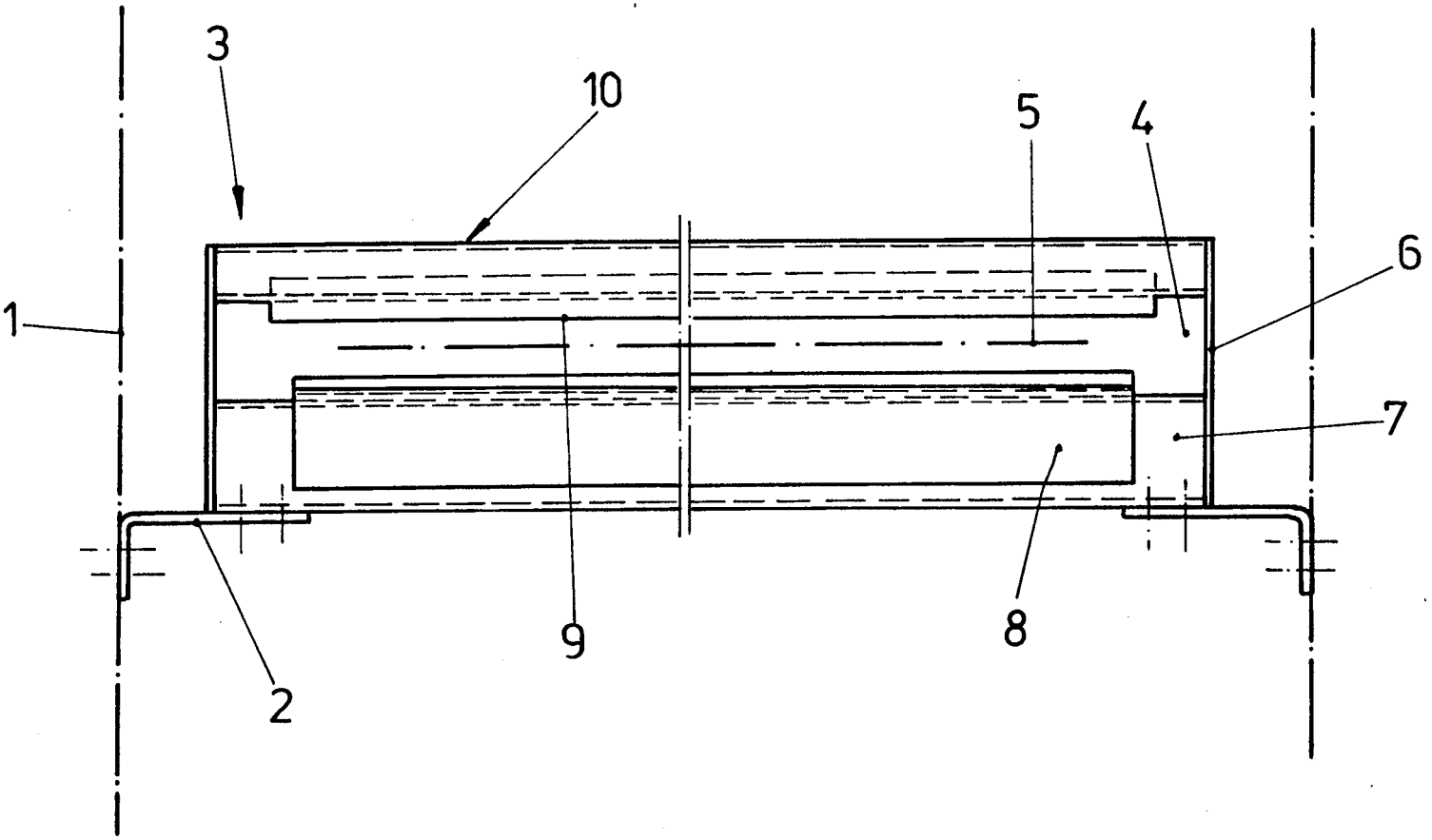
FIG. 1 is an elevation of a web holding and severing device in accordance with the invention from the front end.

The web holding and severing device illustrated in the drawings consists, as best shown in FIG. 1, of a frame 3 mounted with the aid of brackets 2 on the side walls of a web processing machine, as for instance a web feed rotary printing press, such frame defining an access opening 4 for the web 5. The upper and lower legs of the frame arranged across the plane along which the web 5 is conveyed are connected together by lateral shields 6. The lower leg of the frame is constituted by a stationary crosspiece 7, on which a strike beam 8 is mounted. The upper leg of the frame is in the form of a stationary knife beam 10 bearing a stationary knife 9.

Apparatus of this type is more particularly utilized between the last printing unit and a following dryer of the web feed rotary printing press, although it may be provided between the individual printing units. Tripping of the strike beam 8 is performed by means of a web tear detector, not illustrated, responding to a web tear.

Figure 2:
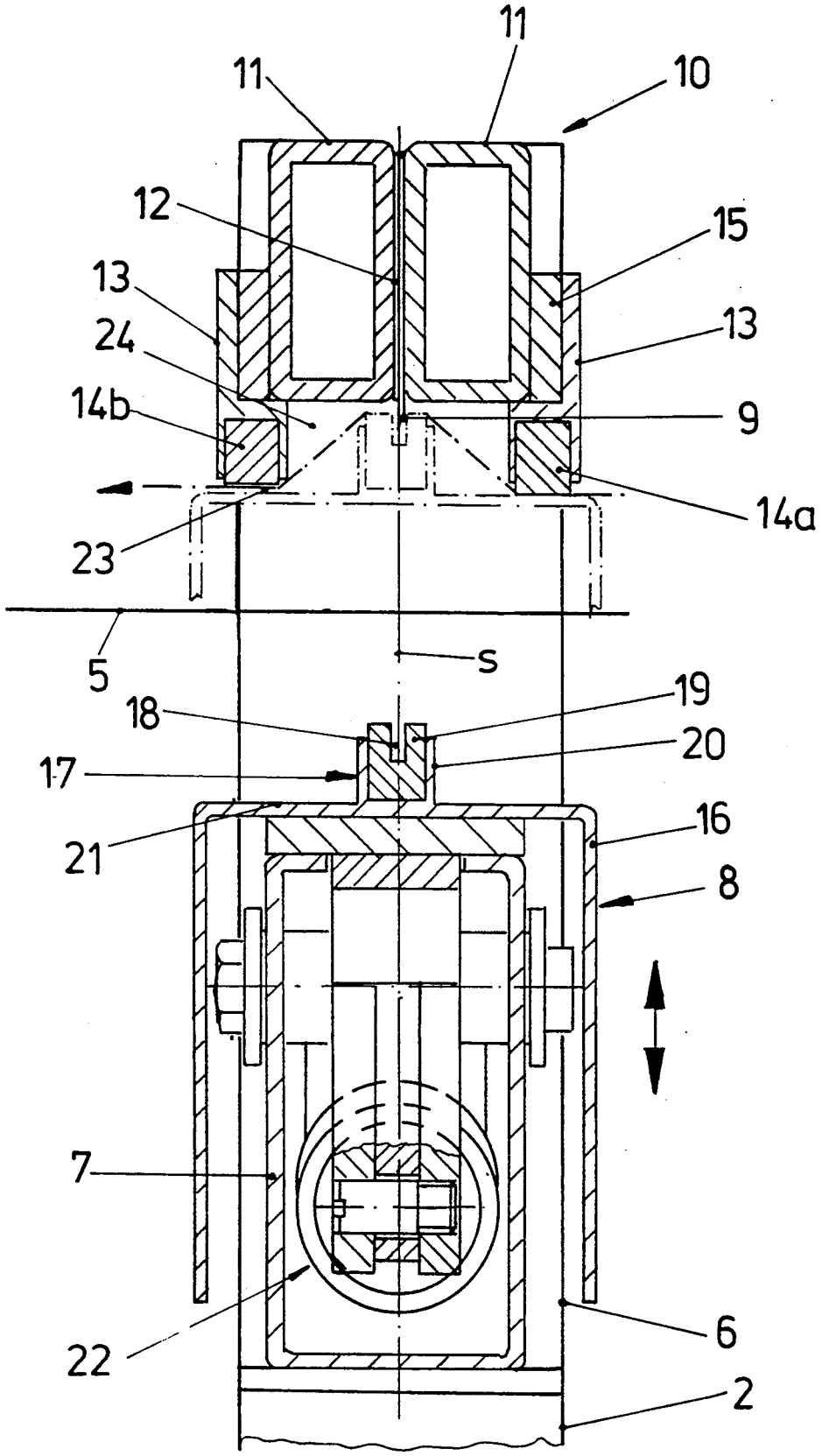
FIG. 2 is vertical section taken through the arrangement illustrated in FIG. 1.

As shown in FIG. 2 the knife beam 10 comprises two lengths of square tube functioning as knife bearing means 11 and to which the knife 9 flanked thereby may be screwed. Owing to the closed or complete cross section (i.e. so that its wall as seen in cross section forms a complete loop) of the tube constituting the two identical knife carriers 11 the arrangement is very robust and resistant to twisting. The two knife carriers 11 are arranged symmetrically to the plane of the section s as shown in broken lines. In order to achieve an exactly centered plane of cutting s despite the cutting edge of the knife 9 constituted by a unilateral chamfer, it is possible for the knife 9 to be set back in steps or, as in the present case, to have a shim 12 placed underneath it. The knife 9 has its cutting edge projecting past the lower side of the knife carrier 11.

Adjacent to the outer, lower corners of the two knife carriers 11 holders 13 are provided arranged symmetrically with respect to the plane s of cutting for rubber bars 14*a* and 14*b* projecting past the cutting edge of the knife 9 downwards. The holders 13 are in the form of h-like sections, which by means of their upper flanges are carried on the respectively associated knife carrier with a shim 15 therebetween in the present case and they have a downwardly opening groove, in which the respectively associated rubber bar 14*a* or 14*b* may be mounted. The rubber bars 14*a* and 14*b* have different heights or sizes in the direction of movement of the strike beam so that the one rubber bar, in the present case the rubber bar 14*a*, comes into engagement prior to the other one.

As furthermore shown in FIG. 2 the strike beam consists of a bar 16 with a U-like cross section arranged to be downwardly open and into which the crosspiece 7 may plunge out of its standby position illustrated in full lines. Adjacent to the upper web, near the knife, of the bar 16 there is a bar-like hump 17, which has a cutting groove 18 arranged symmetrically to the plane s of cutting. In order to form the hump 17 it is possible to provide a rubber bar 19 comprising the cutting groove 18, and which is mounted in a groove delimited by two ribs 20 formed on the bar 16. On either side of the hump 17 flat gripper surfaces 21 are formed by the upper web 16 of the bar 16.

The clearance distance between the rubber bars 14*a* and 14*b* on the knife beam side is equal to at least the width of the hump 17 and in the illustrated working embodiment is approximately three times as great. Between the rubber bars 14*a* and 14*b* there is accordingly a wide channel 24, into which the knife 9 extends from above and into which the hump 17 may plunge from below. The width of the bar 16 is equal to at least the distance between the flanks, turned away from each other, of the rubber bars 14*a* and 14*b* so that an associated gripper surface 21 is opposite to the latter for the full width. The height of the hump 17 of the strike beam is less than the hump constituted by the rubber bars 14*a* and 14*b* of the knife beam so that when in the operational position shown in broken lines the rubber bar 19 having the cutting groove 18 does not quite hit the knife carrier 11.

By means of a push-out device 22 the strike beam 8 may be moved out of its standby position as indicated in full lines into the operational one shown in broken lines. The push-out device 22 may comprise a pivoted lever arrangement with pivoted levers bearinged on the crosspiece 7 and which extending through an associated window in the crosspiece, are in engagement with the bar 16; at least one of these levers is in the form of a toggle lever, which on the other hand is connected with an actuating cylinder as for instance one in the form of a pneumatic cylinder, which is operated by the web tear detector by being filled 7ith compressed fluid. The push-out device 22 including the strike cylinder is located within the crosspiece 7.

In the standby position the strike beam 8 and the knife beam 10 are spaced far apart so that the web 5 will not touch them even in the case of considerable flutter. As soon as a tear in the web is detected the strike beam 8 will be lifted, the higher rubber bar 14*a* of the knife beam 10 then striking the opposite gripper surface 21 of the strike beam. In the same manner the knife 9 will run into the cutting groove 18 and the second, somewhat lower rubber bar 14*b* will remain at a small distance from the opposite gripper surface 21. The web 5 will hence be gripped on the upper rubber bar 14*a*, not on the the lower one 14*b*. The web will be cut by the knife 9 moving into the cutting groove 18, the end of the web so produced and adjacent to the upper rubber bar 14*a* being held by the latter, while the other end of the web may be drawn off through the gap 23 left between the lower rubber bar and the gripper surface 21 spaced from it as shown in FIG. 2 by an arrow. In the illustrated working embodiment of the invention the right run of the web is gripped. If the left run of the web is to be gripped this may be accomplished by mounting the knife beam 10 in a position rotated through 180°. The rubber bars 14*a* and 14*b* simultaneously function as damping or cushioning elements excluding any possibility of metal striking on metal. Simultaneously this feature serves to ensure that the channel 24, in which the cutting operation takes place, is laterally screened. If an operator puts his finger between the knife beam and the strike beam, the rubber bars 14*a* and 14*b* on the knife beam side additionally provides a cushioning action, which is necessary in order to prevent substantial injuries.

We claim:

1. An apparatus for severing and holding a torn web for a web processing machine comprising a knife beam having a stationary knife arranged across a conveying plane of the web, a strike beam having a hump adapted to come into engagement with the knife, a pushout means interactive with said strike beam for lifting and lowering said strike beam, said pushout means being adapted to be activated by a web tear detector, wherein said knife beam comprises two identical bar-like knife carriers holding the knife between them, said knife carriers being provided with symmetrically arranged holders adjacent to a side of said knife carriers facing the strike beam, said holders receiving elastic bars in a position so as to flank the knife, said elastic bars project in relation to a cutting edge of the knife and are spaced apart by a distance at least equal to a width of the hump on the strike beam, said strike beam being formed symmetrically in relation to a plane of cutting and having gripper surfaces which are associated with the elastic bars and flank the hump, said hump being provided with a central cutting groove, and said knife receivable within said cutting groove.

2. The device as claimed in claim 1, wherein the elastic bars differ in size as measured in the direction of movement of the strike beam.

3. The device as claimed in claim 1, wherein at least one of the elastic bars projects past the carriers by a greater amount than the hump having the cutting groove projects past the gripper surfaces.

4. The device as claimed in claim 1, wherein the elastic bars are in the form of rubber bars.

5. The device as claimed in claim 1, wherein the elastic bars are replaceable.

6. The device as claimed in claim 1, wherein the holders are in the form of sections with an h-like outlike provided with a receiving groove and which are adjacent to a lower, outer edge of the knife carriers.

7. The device as claimed in claim 1, wherein each of said knife carriers is in the form of a length of square tube with a wall forming an unbroken loop in cross section.

8. The device as claimed in claim 1, wherein the knife beam is detachably mounted on a frame comprising the strike beam.

9. The device as claimed in claim 8, wherein the frame is adapted to be mounted detachably on brackets provided on side walls of the web processing machine.

10. The device as claimed in claim 8, wherein the frame has lateral shields connecting a crosspiece carrying the strike beam and said push-out means to the knife beam.

11. The device as claimed in claim 10, wherein the strike beam has a length of section material having a U-like cross section open towards the crosspiece, said length of section material spanning said crosspiece.

12. The device as claimed in claim 1, wherein the strike beam is provided with a central receiving groove, said central receiving groove is open toward the knife for receiving another elastic bar, said central receiving groove and said another elastic bar constituting the hump provided with the central cutting groove.

* * * * *